United States Patent [19]

Carlson et al.

[11] Patent Number: 5,032,424

[45] Date of Patent: Jul. 16, 1991

[54] PROCESS FOR PRINTING ON CORRUGATED PAPER BOARD

[75] Inventors: Lloyd P. Carlson, Garden City; Lawrence Ernst, Hicksville; Louis Mazzaferro, Oceanside, all of N.Y.

[73] Assignee: MEC Process Coating Corporation, Uniondale, N.Y.

[21] Appl. No.: 476,720

[22] Filed: Feb. 8, 1990

[51] Int. Cl.[5] ..... B05D 3/06; B05D 5/00

[52] U.S. Cl. ..... 427/56.1; 427/258; 427/288

[58] Field of Search ..... 427/258, 270, 288, 56.1; 34/4, 41

[56] References Cited

U.S. PATENT DOCUMENTS 4,170,681 10/1979 Edwards et al. ..... 427/258 X

*Primary Examiner*—Evan Lawrence

*Attorney, Agent, or Firm*—Kenyon & Kenyon

[57] ABSTRACT

A process for printing the flat top lines of a corrugated paper board in a single pass by a sheet of the board through a top printing rotary letter press printing press and then through a varnishing equipment while the ink is still wet. The sheet having the wet ink and varnish coatings is dried under an infrared heater while forcibly holding it flat against warping.

1 Claim, 1 Drawing Sheet

PROCESS FOR PRINTING ON CORRUGATED PAPER BOARD

Figure 1:
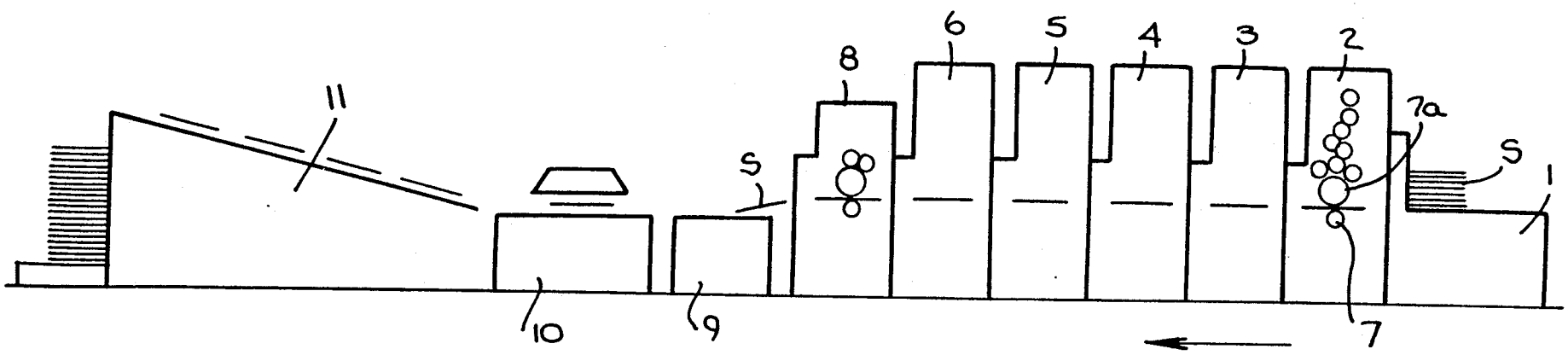

This invention relates to a process for printing on corrugated paper board.

As background, such board comprises flat paper liners adhesively fixed to the crests of a corrugated paper medium. It is rigid to bending but can be crushed by pressure on its liners. It is supplied as sheets used for displays in stores, boxes for containing goods etc., requiring printing of each sheet. No prior art printing process has been completely satisfactory. Printing on single wall flexible sheets as described by U.S. Pat. Nos. 2,696,168 and 3,506,467 does not involve the same problems.

As a brief summary of the process of this invention, a sheet of the board to be printed is positioned horizontally throughout the process. The sheet is first passed through a top printing rotary letter press printing press where a hydrophobic or oil based printing ink is applied to the top liner so heavily that sharply defined printing impressions are obtained without destructive pressure on the board even though the liner may not be perfectly flat. The liner may undulate slightly from crest to crest of the medium. The sheet still horizontal and now carrying the wet printing ink on its top liner is next passed through a varnishing equipment where a coating of hydrophilic or water based varnish is coated over the printing so heavily as to completely cover the printing, again without using destructive pressure on the board. Finally the sheet is passed under an infrared heater radiating heat uniformly to the surface of the sheet carrying the still wet ink and varnish, so as to quickly dry or set the varnish so that the sheet can be piled with other similarly processed sheets. During this heating the sheet is forcibly held against warping so that the uniformly applied heat uniformly heats the sheet's surface.

An example of the practice of this invention is illustrated by the accompanying drawing in which:

FIG. 1 is an elevation view of the equipment used.

This equipment comprises a corrugated paper board sheet feeder 1 where the sheets S are piled horizontally and fed one at a time horizontally to the first of a series of top printing corrugated paper board letter press printing presses 2 to 6 which feed each sheet horizontally from one press to the next in the usual manner. Such presses have a bottom feeding roll 7 and above the sheets a rotary cylindrical printing roll 7*a* carrying the letter press type and an ink roll 8 applying ink to the type. When multi-color printing is not required there may be only one press. The final press feeds each sheet horizontally to a coating machine 8 where a varnish is coated on the top liner of each sheet to cover the still wet ink. The amount of ink, the amount of varnish and the pressure on the sheets can be controlled. The ink is hydrophobic or oil based and the varnish is hydrophilic or water based. Drying or setting of the varnish to a dry hard film permits handling of the sheets as by piling for example. There is not much time for this drying because the presses and coating machine are rotary and the sheets move rapidly through the equipment. In the example of equipment a conveyor 9 carries the sheets from the coating machine 8 horizontally to a drying or setting equipment 10 and from it to a stacker 11.

According to the present invention the ink is applied by each press at a film ink thickness of at least 1.5 pounds per thousand square feet of the printed area and up to 2.25 pounds per square foot of printed area. Although the printing pressure is maintained safely below that which might crush the corragated paper board sharp and well defined impressions are formed. The ink cannot gravitationaly flow because each sheet is maintained horizontally. Each sheet carrying the ink is next passed through the coating machine were the varnish is coated on the wet printing ink at a film thickness of from 1.5 pounds to 2.25 pounds per thousand square feet of coated area.

Carrying the unusually thick layer or film of varnish each sheet is subjected to infrared radiation applied uniformally over the sheet's top surface. This drying must keep up with the sheets delivered from the coating equipment so intense heating is necessary, and to prevent warping of the sheets each is forcibly held completely flat during the heating. A flat vacuum table may be used which evacuates air from the bottom of the sheet so that the atmospheric pressure presses the sheet forcibly onto the table. Any conveying means may be used to feed the sheet over and from the table.

After this drying the sheets which can now be handed are stacked or horzontally piled by the stacker 11. Only one pass through the equipment produces sheets having sharply defined printing and ready for use.

We claim:

1. A process for printing on corrugated paper board, the board comprising flat paper liners adhesively fixed to the crests of a corrugated paper medium, the process comprising positioning a sheet of the board horizontally continuously throughout the process, passing the sheet through a top printing rotary letter press printing press applying a hydrophobic or oil based printing ink to the sheet's top liner at a film ink thickness of from 1.5 pounds to 2.25 pounds per thousand square feet of the printed area with a printing pressure below that crushing the sheet and forming wet printing ink impressions on the top liner, passing the sheet with the ink impressions still wet through a varnishing equipment applying a hydrophilic or water based varnish covering the wet ink impressions at a film thickness of from 1.5 to 2.25 pounds per thousand square feet of coated area and forming a wet varnish coating on the top liner, and passing the sheet with the ink and the varnish coating still wet under an infrared heater radiating heat uniformly to the varnish coating while forcibly holding the sheet flat against warping, and drying or setting the varnish.

* * * * *